US012528656B2

(12) United States Patent
Shimosaka et al.

(10) Patent No.: US 12,528,656 B2
(45) Date of Patent: Jan. 20, 2026

(54) MEDIUM CONVEYANCE DEVICE

(71) Applicant: PFU LIMITED, Kahoku (JP)

(72) Inventors: Kiichiro Shimosaka, Kahoku (JP); Hideyuki Okumura, Kahoku (JP)

(73) Assignee: PFU LIMITED, Kahoku (JP)

( * ) Notice: Subject to any disclaimer, the term of this patent is extended or adjusted under 35 U.S.C. 154(b) by 142 days.

(21) Appl. No.: 17/904,762

(22) PCT Filed: Mar. 18, 2020

(86) PCT No.: PCT/JP2020/012117
§ 371 (c)(1),
(2) Date: Aug. 22, 2022

(87) PCT Pub. No.: WO2021/186644
PCT Pub. Date: Sep. 23, 2021

(65) Prior Publication Data

US 2023/0038655 A1 Feb. 9, 2023

(51) Int. Cl.
*B65H 5/06* (2006.01)

(52) U.S. Cl.
CPC ..... *B65H 5/06* (2013.01)

(58) Field of Classification Search
CPC .. B65H 5/06; B65H 5/062; B65H 2404/1312; B65H 2404/13171; B65H 2404/1121
See application file for complete search history.

(56) References Cited

U.S. PATENT DOCUMENTS 4,693,587 A * 9/1987 Shigenobu ..... G03G 15/2092 162/271
6,318,141 B1 * 11/2001 Tokunaga ..... B21D 1/02 72/205

(Continued)

FOREIGN PATENT DOCUMENTS

JP 6-15374 * 1/1994
JP 2005-67806 A 3/2005

(Continued)

OTHER PUBLICATIONS

Machine translation of JP6-15374. (Year: 1994).*

(Continued)

*Primary Examiner* — Thomas A Morrison
(74) *Attorney, Agent, or Firm* — Womble Bond Dickinson (US) LLP

(57) ABSTRACT

A medium conveying apparatus includes feed roller pairs spaced and located in a direction perpendicular to a medium conveying direction, to separate and feed a medium, and conveying roller pairs located on a downstream side of the feed roller pairs in the medium conveying direction, and spaced and located in the direction perpendicular to the medium conveying direction. For each of the conveying roller pairs, a diameter of an outer end in the direction perpendicular to the medium conveying direction of at least one conveying roller is larger than a diameter of an inner end in the direction perpendicular to the medium conveying direction of said conveying roller, and a total D of differences between the diameter of the outer end and the diameter of the inner end of each conveying roller is 0.06 mm or more and 1.00 mm or less.

2 Claims, 11 Drawing Sheets

(56) References Cited

U.S. PATENT DOCUMENTS

| | | | | |
|---|---|---|---|---|
| 7,706,738 | B2 * | 4/2010 | Ahn | G03G 15/6552 399/405 |
| 2018/0057288 | A1 | 3/2018 | Mizuguchi | |
| 2019/0256309 | A1 * | 8/2019 | Shiota | B65H 7/125 |
| 2019/0310579 | A1 * | 10/2019 | Koizumi | B65H 5/062 |

FOREIGN PATENT DOCUMENTS

| | | | |
|---|---|---|---|
| JP | 6579062 | B | 9/2019 |
| JP | 2019-182584 | A | 10/2019 |

OTHER PUBLICATIONS

Japanese Office Action dated Mar. 28, 2023 regarding Japanese Patent Application No. 2022-507935 corresponding to U.S. Appl. No. 17/904,762 (2 pages) with English Translation (3 pages).

Japanese Office Action dated Dec. 27, 2022 regarding Japanese Patent Application No. 2022-507935 corresponding to U.S. Appl. No. 17/904,762 (2 pages) with English Translation (4 pages).

International Search Report dated Apr. 21, 2020 for corresponding Japanese PCT Application No. PCT/JP2020/012117 (3 pages) with English Translation (2 pages).

Written Opinion dated Apr. 21, 2020 for corresponding Japanese PCT Application No. PCT/JP2020/012117 (3 pages) with English Translation (3 pages).

International Preliminary Report on Patentability dated Sep. 20, 2022 for corresponding Japanese PCT Application No. PCT/JP2020/012117 (4 pages) with English Translation (4 pages).

* cited by examiner

MEDIUM CONVEYANCE DEVICE

CROSS-REFERENCE TO RELATED APPLICATION(S)

This application is a U.S. National Phase Patent Application and claims priority to and the benefit of International Application Number PCT/JP2020/012117, filed on Mar. 18, 2020, the entire content of which is incorporated herein by reference.

FIELD

The present disclosure relates to a medium conveying apparatus, and more particularly to a medium conveying apparatus to separate and feed a medium.

BACKGROUND

In general, a medium conveying apparatus, such as a scanner device, is provided with a pair of feed rollers to feed and separate a plurality of media placed on a medium tray. However, a force from both ends toward the center side in a width direction perpendicular to a medium conveying direction by a separation force by the pair of feed rollers may be applied to the medium conveyed by the medium conveying apparatus, and wrinkles (deflections) may occur in the medium. When the wrinkles occur in the conveyed medium, a color unevenness may occur (a light area and a dark area may be mixed) in the image captured by imaging the medium. On the other hand, when a simple force is applied to the conveyed medium from the center side toward both end sides in the width direction in order to prevent the occurrence of the wrinkles, a thin paper conveyed as the medium may be broken (ruptured).

An image forming apparatus including a pair of driving roller segments located at symmetrical positions on the left and right of a paper feed center line is disclosed (see Patent Literature 1). The driving roller segments are formed in a symmetrical tapered shape in which the paper feed center line side is thick and the opposite side thereof is narrow.

An image forming apparatus including two roller portions located at predetermined intervals is disclosed (see Patent Literature 2). In the image forming apparatus, the two roller portions are located so that ends formed in a small diameter by a draft angle thereof face each other, and ends formed in a large diameter by the draft angle thereof face outer side each other.

CITATION LIST

Patent Literature

Patent Literature 1: Japanese Unexamined Patent Publication No. 2005-67806

Patent Literature 2: Japanese Patent No. 6579062

SUMMARY

It is desired for the medium conveying apparatus to suppress the occurrence of the wrinkles of the medium while suppressing the occurrence of the breakage of the medium.

An object of the medium conveying apparatus is to enable suppressing the occurrence of the wrinkles of the medium while suppressing the occurrence of the breakage of the medium.

According to some embodiments, a medium conveying apparatus includes feed roller pairs spaced and located in a direction perpendicular to a medium conveying direction, to separate and feed a medium, and conveying roller pairs located on a downstream side of the feed roller pairs in the medium conveying direction, and spaced and located in the direction perpendicular to the medium conveying direction. For each of the conveying roller pairs, a diameter of an outer end in the direction perpendicular to the medium conveying direction of at least one conveying roller is larger than a diameter of an inner end in the direction perpendicular to the medium conveying direction of said conveying roller, and a total D of differences between the diameter of the outer end and the diameter of the inner end of each conveying roller is 0.06 mm or more and 1.00 mm or less.

According to the present embodiment, the medium conveying apparatus can suppress the occurrence of the wrinkles of the medium while suppressing the occurrence of the breakage of the medium.

The object and advantages of the invention will be realized and attained by means of the elements and combinations, in particular, described in the claims. It is to be understood that both the foregoing general description and the following detailed description are exemplary and explanatory, and are not restrictive of the invention, as claimed.

DESCRIPTION OF EMBODIMENTS

Hereinafter, a medium conveying apparatus according to an embodiment, will be described with reference to the drawings. However, it should be noted that the technical scope of the invention is not limited to these embodiments, and extends to the inventions described in the claims and their equivalents.

Figure 1:
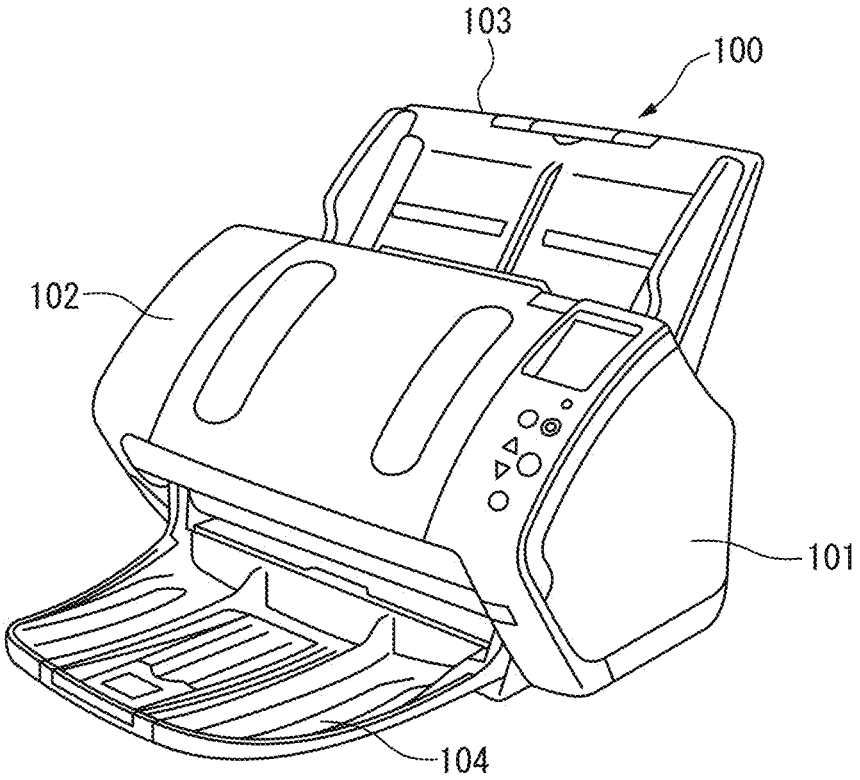
FIG. 1 is a perspective view illustrating a medium conveying apparatus 100 according to the embodiment.

FIG. 1 is a perspective view illustrating a medium conveying apparatus 100 configured as an image scanner. The medium conveying apparatus 100 conveys and images a medium being a document. The medium may be a paper, such as a PPC (Plain Paper Copier) paper, a thin paper, a thick paper, a plastic card, a brochure or a passport, etc. The medium conveying apparatus 100 may be a fax machine, a copying machine, a multifunctional peripheral (MFP), etc. A conveyed medium may not be a document but may be an object being printed on etc., and the medium conveying apparatus 100 may be a printer etc.

The medium conveying apparatus 100 includes a lower housing 101, an upper housing 102, a medium tray 103, and an ejection tray 104, etc.

The upper housing 102 is located at a position covering the upper surface of the medium conveying apparatus 100 and is engaged with the lower housing 101 by hinges so as to be opened and closed at a time of medium jam, during cleaning the inside of the medium conveying apparatus 100, etc.

The medium tray 103 is engaged with the lower housing 101 in such a way as to be able to place a medium to be conveyed. The ejection tray 104 is engaged with the lower housing 101 in such a way as to be able to hold an ejected medium.

Figure 2:
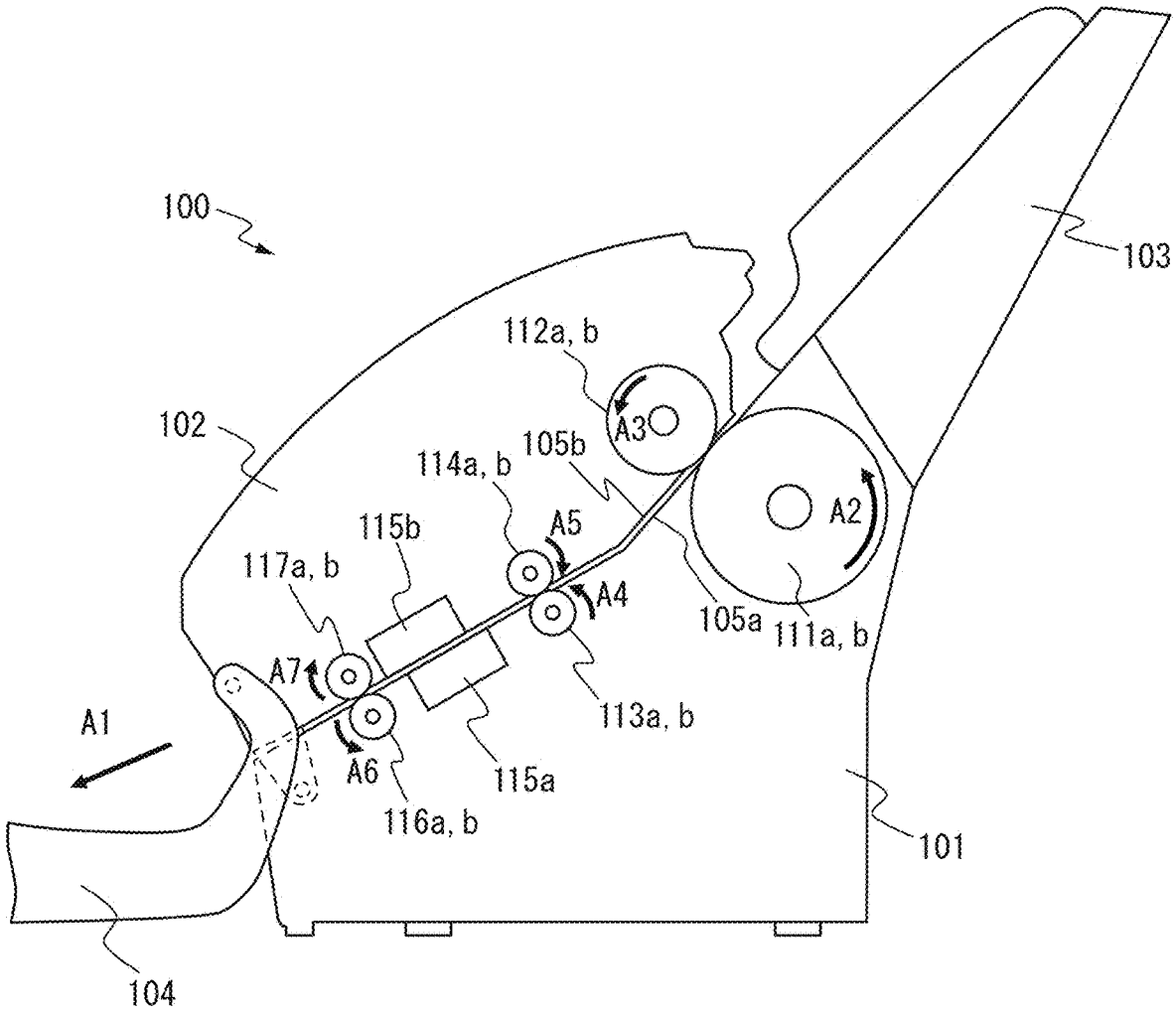
FIG. 2 is a diagram for illustrating a conveyance path inside the medium conveying apparatus 100.

FIG. 2 is a diagram for illustrating a conveyance path inside the medium conveying apparatus 100.

The conveyance path inside the medium conveying apparatus 100 includes feed rollers 111*a* and 111*b*, brake rollers 112*a* and 112*b*, first conveyance rollers 113*a* and 113*b*, second conveyance rollers 114*a* and 114*b*, a first imaging device 115*a*, a second imaging device 115*b*, third conveyance rollers 116*a* and 116*b*, and fourth conveyance rollers 117*a* and 117*b*. An arrow A1 in FIG. 2 indicates a medium conveying direction. Hereinafter, an upstream refers to an upstream in the medium conveying direction A1, and a downstream refers to a downstream in the medium conveying direction A1.

Hereinafter, the feed rollers 111*a* and 111*b* may be collectively referred to as feed rollers 11. The brake rollers 112*a* and 112*b* may be collectively referred to as brake rollers 112. The first conveyance rollers 113*a* and 113*b* may be collectively referred to as first conveyance rollers 113. The second conveyance rollers 114*a* and 114*b* may be collectively referred to as second conveyance rollers 114. The first imaging device 115*a* and the second imaging device 115*b* may be collectively referred to as an imaging device 115. The third conveyance rollers 116*a* and 116*b* may be collectively referred to as third conveyance rollers 116. The fourth conveyance rollers 117*a* and 117*b* may be collectively referred to as fourth conveyance rollers 117. The number of each roller may be one, or three or more.

An upper surface of the lower housing 101 forms a lower guide 105*a* forming a lower surface of the medium conveyance path, and a lower surface of the upper housing 102 forms an upper guide 105*b* forming an upper surface of the medium conveyance path.

The feed rollers 111 and the brake rollers 112 are an example of feed roller pairs, and rotate according to a driving force from a motor (not shown), to separate and feed the medium. The feed rollers 111 are provided on the lower housing 101 and sequentially feed media placed on the medium tray 103 from the lower side. The brake rollers 112 are provided in the upper housing 102 and are located to face the feed rollers 111.

The first conveyance rollers 113 and the second conveyance rollers 114 are an example of conveying roller pairs, and rotate according to a driving force from a motor (not shown), to convey the medium fed by the feed rollers 111 and the brake rollers 112 to the downstream side. The first conveyance rollers 113 and the second conveyance roller 114 are located on the downstream side of the feed roller 111 and the brake roller 112 in the medium conveying direction A1. The first conveyance rollers 113 are provided on the lower housing 101. The second conveyance rollers 114 are provided in the upper housing 102, and are located to face the first conveyance roller 113. One rollers of the first conveyance rollers 113 and the second conveyance rollers 114 may be driven rollers which are driven according to the rotation of the other rollers. The first conveyance rollers 113 and the second conveyance rollers 114 are formed by a rubber member or a resin member, etc. For example, the rollers which rotate according to the driving force from the motor are formed of a rubber member, and the driven rollers which are driven according to the rotation of the other rollers are formed of a resin member.

The first imaging device 115*a* includes a line sensor based on a unity-magnification optical system type contact image sensor (CIS) including an imaging element based on a complementary metal oxide semiconductor (CMOS) linearly located in a main scanning direction. Further, the first imaging device 115*a* includes a lens for forming an image on the imaging element, and an A/D converter for amplifying and analog-digital (A/D) converting an electric signal output from the imaging element. The first imaging device 115*a* generates and outputs an input image imaging a front surface of a conveyed medium, in accordance with control from a processing circuit (not shown).

Similarly, the second imaging device 115*b* includes a line sensor based on a unity-magnification optical system type CIS including an imaging element based on a CMOS linearly located in a main scanning direction. Further, the second imaging device 115*b* includes a lens for forming an image on the imaging element, and an A/D converter for amplifying and A/D converting an electric signal output from the imaging element. The second imaging device 115*b* generates and outputs an input image imaging a back surface of a conveyed medium, in accordance with control from the processing circuit.

Only either of the first imaging device 115*a* and the second imaging device 115*b* may be located in the medium conveying apparatus 100 and only one surface of a medium may be read. Further, a line sensor based on a unity-magnification optical system type CIS including an imaging element based on charge coupled devices (CCDs) may be used in place of the line sensor based on a unity-magnification optical system type CIS including an imaging element based on a CMOS. Further, a line sensor based on a reduction optical system type line sensor including an imaging element based on CMOS or CCDs.

The third conveyance rollers 116 and the fourth conveyance rollers 117 rotate according to a driving force from a motor (not shown), to convey the medium conveyed by the first conveyance rollers 113 and the second conveyance rollers 114 to the further downstream side. The third conveyance rollers 116 and the fourth conveyance rollers 117 are located on the downstream side of the first conveyance rollers 113 and the second conveyance rollers 114 in the medium conveying direction A1. The third conveyance rollers 116 are provided on the lower housing 101. The fourth conveyance rollers 117 are provided in the upper housing 102, and are located to face the third conveyance rollers 116. One rollers of the third conveyance rollers 116 and the fourth conveyance rollers 117 may be driven rollers which are driven according to the rotation of the other rollers.

The medium placed on the medium tray 103 is conveyed in the medium conveying direction A1 between the lower guide 105*a* and the upper guide 105*b* by the feed rollers 111 rotating in a direction of an arrow A2 in FIG. 2, that is, a medium feeding direction. When the medium is conveyed, the brake rollers 112 rotate in a direction of an arrow A3, that is, a direction opposite to the medium feeding direction. By the workings of the feed rollers 111 and the brake rollers 112, when a plurality of media are placed on the medium tray 103, only a medium in contact with the feed rollers 111, out of the media placed on the medium tray 103, is separated. Consequently, the medium conveying apparatus 100 operates in such a way that conveyance of a medium other than the separated medium is restricted (prevention of multi-feed).

The medium is fed between the first conveyance rollers 113 and the second conveyance rollers 114 while being guided by the lower guide 105*a* and the upper guide 105*b*. The medium is fed between the first imaging device 115*a* and the second imaging device 115*b* by the first conveyance rollers 113 and the second conveyance rollers 114 rotating in directions of arrows A4 and A5, respectively. The medium read by the imaging device 115 is ejected on the ejection tray 104, by the third conveyance rollers 116 and the fourth conveyance rollers 117 rotated in directions of arrows A6 and A7, respectively.

Figure 3:
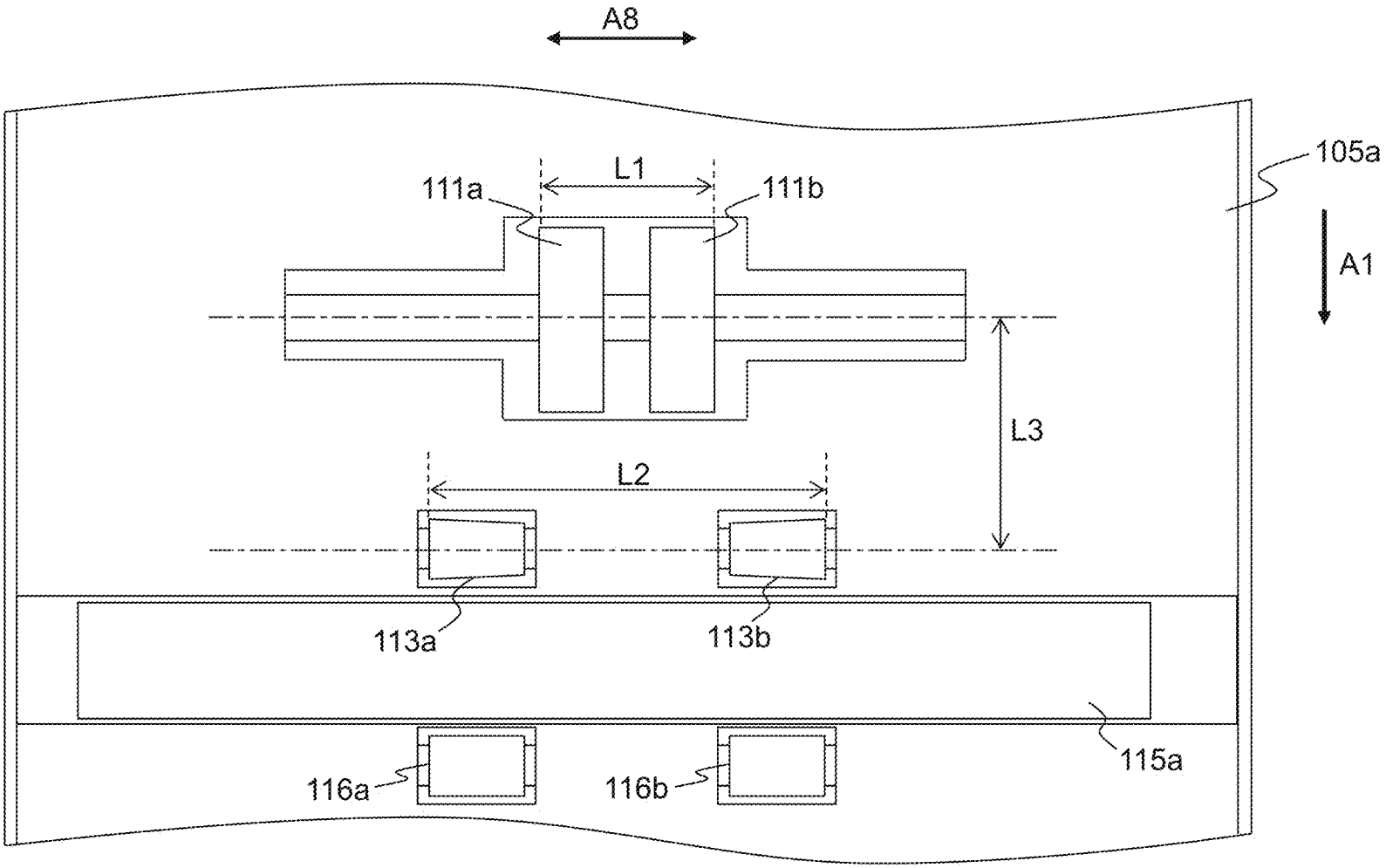
FIG. 3 is a schematic diagram for illustrating an arrangement of each roller.

FIG. 3 is a schematic diagram for illustrating an arrangement of each roller. FIG. 3 is a schematic diagram of the lower housing 101 from above in a state in which the upper housing 102 is removed.

As shown in FIG. 3, the feed rollers 111*a* and 111*b* are spaced and located along in the width direction A8 perpendicular to the medium conveying direction, and the brake rollers 112*a* and 112*b* facing the feed rollers 111*a* and 111*b* are also spaced and located along in the width direction A8. The first conveyance rollers 113*a* and 113*b* are spaced and located along in the width direction A8, and the second conveyance rollers 114*a* and 114*b* facing the first conveyance rollers 113*a* and 113*b* are also spaced and located along in the width direction A8. The third conveyance rollers 116*a* and 116*b* are spaced and located along in the width direction A8, and the fourth conveyance rollers 117*a* and 117*b* facing the third conveyance rollers 116*a* and 116*b* are also spaced and located along in the width direction A8.

Further, each of the feed roller pairs and each of the conveying roller pairs are provided in such a way that a distance L2 between outer ends of the conveying roller pairs in the width direction A8 is larger than a distance L1 between outer ends of the feed roller pairs in the width direction A8. Further, the feed roller pairs and the conveying roller pairs are located so that a position of a rotation axis of each roller of the conveying roller pairs is located on the downstream side of a position of a rotation axis of each roller of the feed roller pairs by a distance L3 in the medium conveying direction A1. That is, the distance L3 is a distance between the rotation axis of the feed roller pairs and the rotation axis of the conveying roller pairs in the medium conveying direction A1.

Figure 4:
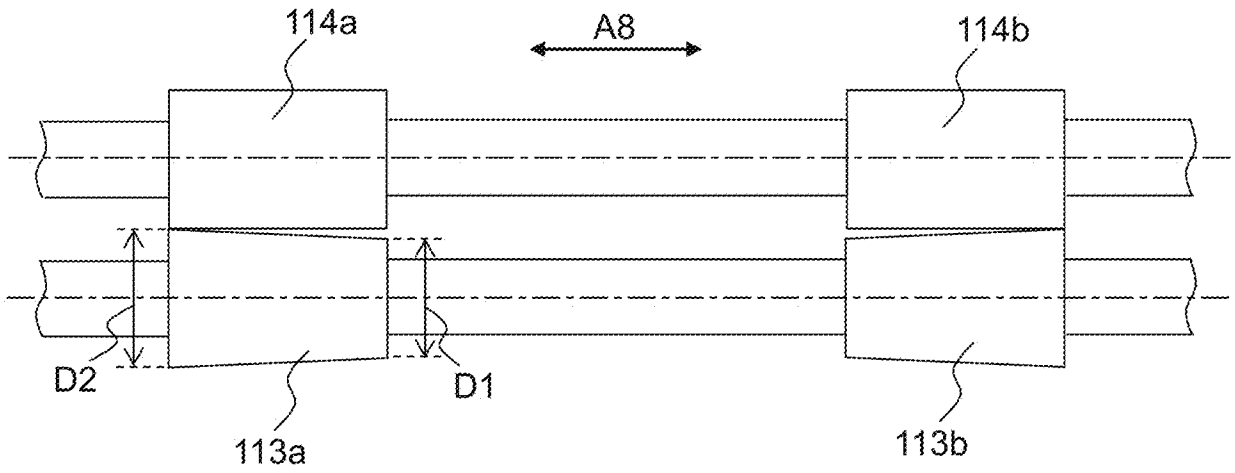
FIG. 4 is a schematic diagram for illustrating a shape of a first conveyance roller 113.

FIG. 4 is a schematic diagram for illustrating a shape of the first conveyance rollers 113. FIG. 4 is a schematic diagram of the first conveyance rollers 113 and the second conveyance rollers 114 in a state in which they are removed from the medium conveying apparatus 100, viewed from the downstream side.

As shown in FIG. 4, the first conveyance rollers 113 have a truncated cone shape, and are provided so that a surface having the larger diameter is located on the outside in the width direction A8, and a surface having the smaller diameter is located on the center side in the width direction A8, respectively. That is, the first conveyance rollers 113 are provided in such a way that a diameter D2 of an outer end in the width direction A8 of the first conveyance roller 113 is larger than a diameter D1 of an inner end in the width direction A8 of the first conveyance roller 113, respectively. On the other hand, the second conveyance rollers 114 have a cylindrical shape, and are provided so that diameters are substantially uniform at each position in the width direction A8 of the second conveyance rollers 114, respectively.

The first conveyance rollers 113 and the second conveyance rollers 114 (the conveying roller pairs) are provided in such a way that a total D of differences (amounts of tapers) between the diameter of the outer end of each conveyance roller and the diameter of the inner end of each conveyance roller is 0.06 mm or more and 1.00 mm or less, respectively. In particular, the first conveyance rollers 113 and the second conveyance rollers 114 (the conveying roller pairs) are provided in the medium conveying apparatus 100 in such a way that the total D of the differences between the diameter of the outer end of each conveyance roller and the diameter of the inner end of each conveyance roller satisfies the following equation (1), respectively.

$$D \geq (-0.013) \times \{L3/(L2-L1))\} + 0.1045 \quad (1)$$

In the present embodiment, since the difference between the diameter of the outer end and the diameter of the inner end of each of the second conveyance rollers 114 is 0, the difference between the diameter D2 of the outer end and the diameter D1 of the inner end of each of the first conveyance rollers 113 is equal to the total D of the difference between the diameter of the outer end and the diameter of the inner end of each conveyance roller.

Hereinafter, the technical significance setting the total D of the difference between the diameter D2 of the outer end and the diameter D1 of the inner end of each conveyance roller to 0.06 mm or more and 1.00 mm or less, will be described.

Figure 5:
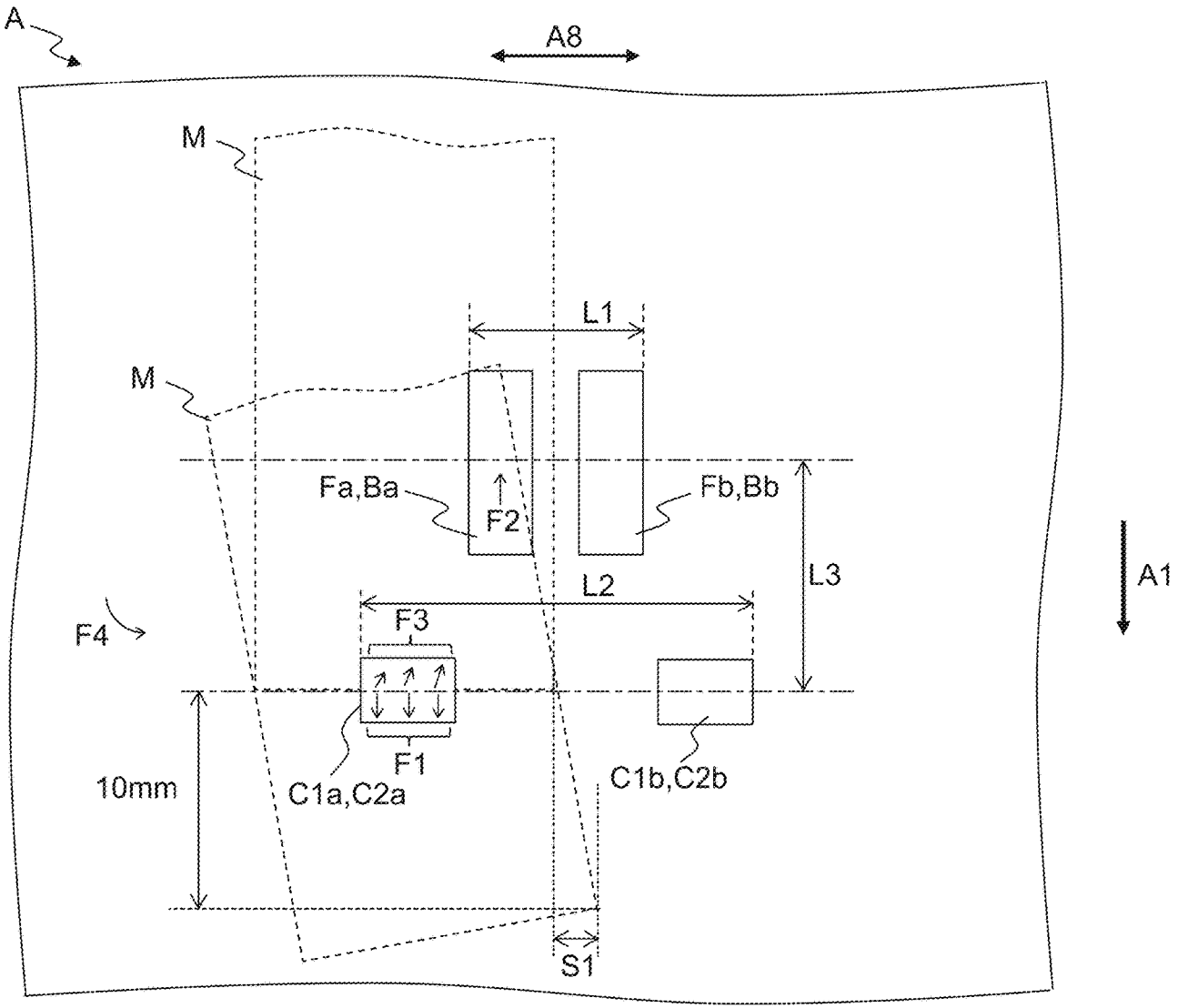
FIG. 5 is a schematic diagram for illustrating a force applied to the medium.

FIG. 5 is a schematic diagram for illustrating a force applied to a conveyed medium in a medium conveying apparatus A having a separating function of a medium.

FIG. 5 shows a schematic view of a conveyance path of the medium conveying apparatus A. The conveyance path is provided with a plurality of feed rollers Fa, Fb, a plurality of brake rollers Ba, Bb, a plurality of first conveyance rollers C1*a*, C1*b* and a plurality of second conveyance rollers C2*a*, C2*b*, respectively, spaced and located along in the width direction A8. The first conveyance rollers C1*a*, C1*b*, and the second conveyance rollers C2*a*, and C2*b* have a cylindrical shape, and are provided in such a way that diameters are uniform at each position in the width direction A8, respectively. Further, in the width direction A8, the outer ends of the first conveyance rollers C1*a*, C1*b* and the second conveyance rollers C2*a*, C2*b* are located outside the outer ends of the feed rollers Fa, Fb and the brake rollers Ba, Bb, respectively.

FIG. 5 shows a state in which a medium M acquired by cutting the A4-size paper into half at a center position in the width direction A8 is conveyed by the feed roller Fa, the brake roller Ba, the first conveyance roller C1*a* and the second conveyance roller C2*a*. A force F1 toward the medium conveying direction A1 is applied to an area in contact with the first conveyance roller C1*a* and the second conveyance roller C2*a* of the medium M, by the first conveyance roller C1*a* and the second conveyance roller C2*a*. On the other hand, a force F2 toward a direction opposite to the medium conveying direction A1 is applied to an area in contact with the feed roller Fa and the brake roller Ba of the medium M, by the brake roller Ba. By the force F2, a force F3 for pulling toward the brake roller Ba side is applied to the area in contact with the first conveyance roller C1*a* and the second conveyance roller C2*a* of the medium M, and the medium is easily slipped.

A degree to which the medium slips by the force F3 is larger as the position is closer to the brake roller Ba, and is smaller as the position is far from the brake roller Ba. Therefore, the medium M is more easily slip in the central area than in the outer area in the width direction A8, and a force F4 for rotating toward the center side in the width direction A8 is applied to the entire medium M. As shown in FIG. 5, the medium M conveyed by the feed roller Fa, the brake roller Ba, the first conveyance roller C1*a* and the second conveyance roller C2*a*, is conveyed inclined to the first conveyance roller C1*b* side in the width direction A8. On the other hand, when the medium is conveyed by the feed rollers Fa, Fb, the brake rollers Ba, Bb, the first conveyance rollers C1*a*, C1*b* and the second conveyance rollers C2*a*, C2*b*, a force from both end sides toward the center side is applied to the conveyed medium, and the wrinkles (deflection) may occur.

In the width direction A8, a variation in the force F3 at each position in the area in contact with the first conveyance roller C1*a* and the second conveyance roller C2*a* of the medium M is larger, as the outer end of the first conveyance roller C1*a* and the second conveyance roller C2*a* is far from the outer end of the brake roller Ba. That is, the movement amount of the medium M moving to the first conveyance roller C1*b* side in the width direction A8 is lager, as the difference between the distance L2 between the outer ends of the first conveyance roller and the second conveyance roller in the width direction A8, and the distance L2 between the outer ends of the feed roller and the brake roller in the width direction A8 is larger. In FIG. 5, the movement amount S1 indicates the movement amount of the medium M moving to the first conveyance roller C1*b* side in the width direction A8 when the medium M is conveyed by 100 mm in the medium conveying direction A1. The movement amount S1 is a factor to generate the wrinkles in the medium.

On the other hand, in the medium conveying direction A1, the force F3 at each position in the area in contact with the first conveyance roller C1*a* and the second conveyance roller C2*a* of the medium M are uniform, as the distance between the rotation axis of the first conveyance roller C1*a* and the second conveyance roller C2*a* and the rotation axis of the brake roller Ba is larger. That is, the movement amount S1 is smaller, as the distance L3 between the rotation axes of the feed rollers and the brake rollers and the rotation axes of the first conveyance rollers and the second conveyance rollers in the medium conveying direction A1 is larger.

Figure 6:
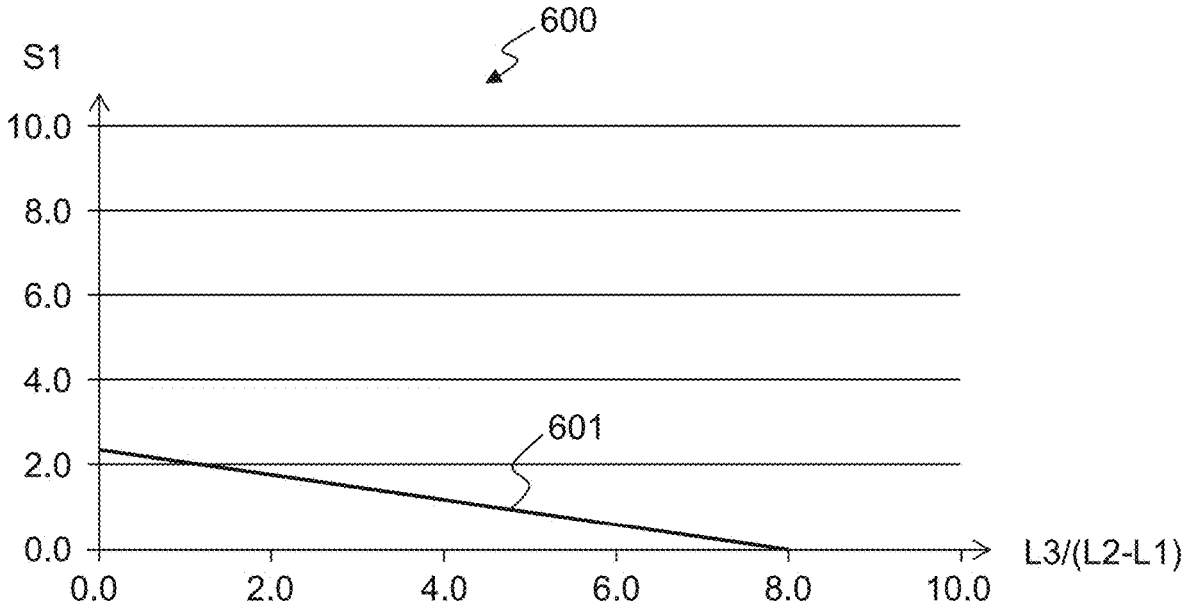
FIG. 6 is a graph showing a relationship between distances L1, L2 and L3, and a movement amount S1.

FIG. 6 is a graph 600 showing a relationship between the distances L1, L2 and L3, and the movement amount S1.

In FIG. 6, the horizontal axis indicates {L3/(L2−L1)}, the vertical axis indicates the movement amount S1 [mm]. A straight line 601 of the graph 600 is acquired by experiments in which the movement amount S1 is measured while changing the position of each roller in such a way that the distance L1, L2 and L3 change. As described above, as the difference between the distance L2 and the distance L1 is larger, {L3/(L2−L1)} is smaller, and the movement amount S1 is larger. On the other hand, as the distance L3 is larger, {L3/(L2−L1)} is larger, and the movement amount S1 is smaller. From the straight line 601, the following relational equation (2) is derived.

$$(S1)=(-0.2919)\times\{L3/(L2-L1)\}+(2.347) \quad (2)$$

Figure 7:
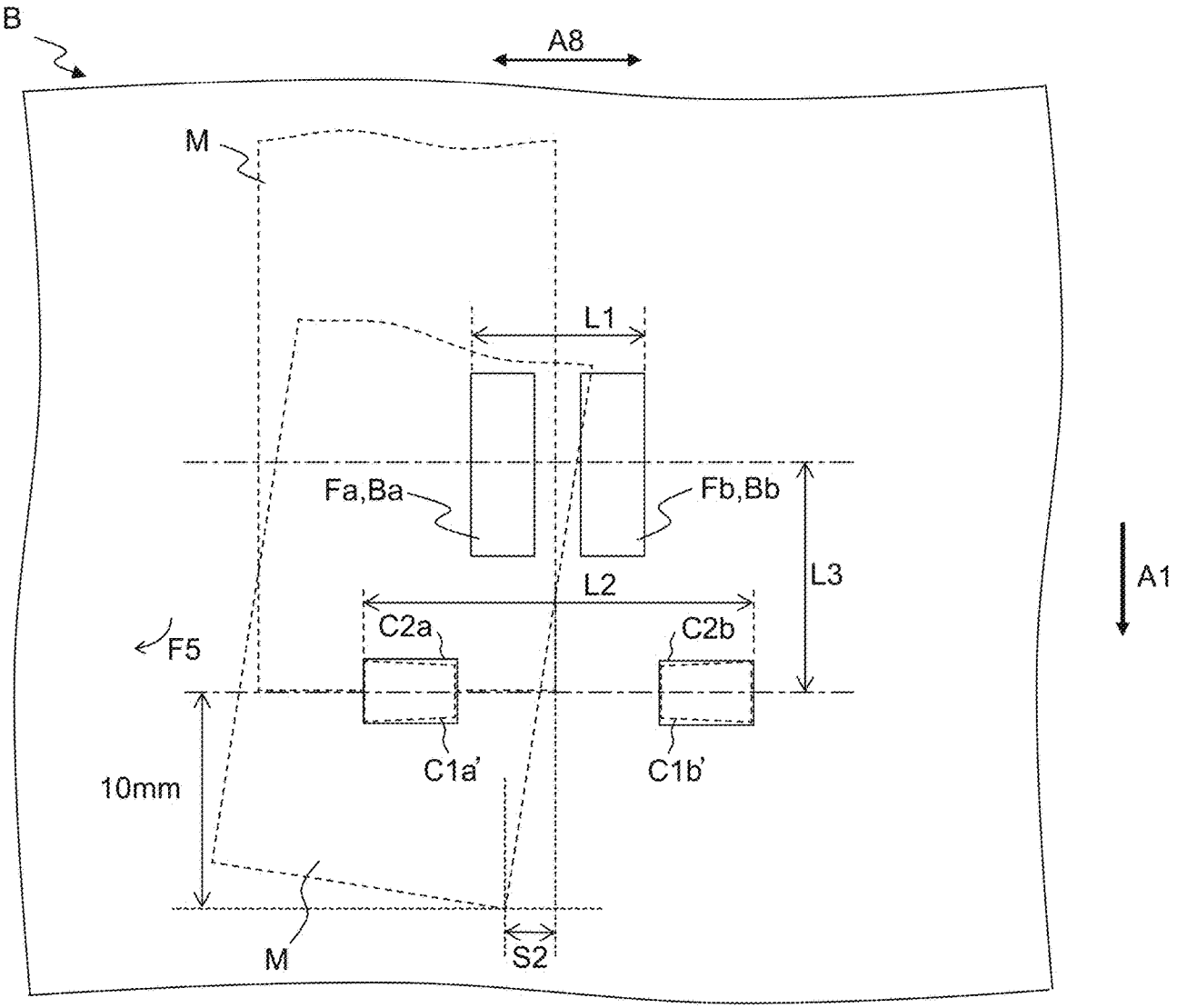
FIG. 7 is a schematic diagram for illustrating a force applied to the medium.

FIG. 7 is a schematic diagram for illustrating a force applied to the conveyed medium when diameters at respective positions in the width direction A8 of the first conveyance roller are different.

FIG. 7 shows a schematic view of a conveyance path of a medium conveying apparatus B. The medium conveying apparatus B has a configuration similar to the medium conveying apparatus A. However, the medium conveying apparatus B is provided with first conveyance rollers C1*a*', C1*b*', instead of the first conveyance rollers C1*a*, C1*b*. The first conveyance rollers C1*a*', C1*b*' have a truncated cone shape, the first conveyance roller C1*a*', in such a way that a diameter D2 of the outer end in the width direction A8 of the first conveyance rollers C1*a*' and C1*b*' is larger than a diameter D1 of the inner end in the width direction A8 of the first conveyance rollers C1*a*' and C1*b*'.

Similarly to FIG. 5, FIG. 7 shows a state in which a medium M acquired by cutting the A4-size paper into half at a center position in the width direction A8 is conveyed by the feed roller Fa, the brake roller Ba, the first conveyance roller C1*a*' and the second conveyance roller C2*a*. In general, when the medium is conveyed by a roller having a truncated cone shape, the medium is conveyed inclined toward the end whose diameter is larger. Accordingly, a force F5 for rotating to the outside in the width direction A8 is applied to the entire medium M by the first conveyance roller C1*a*'. As shown in FIG. 7, the medium M conveyed by the feed roller Fa, the brake roller Ba, the first conveyance roller C1*a*' and the second conveyance roller C2*a* is conveyed inclined to the first conveyance roller C1*a*' side in the width direction A8. On the other hand, when the medium is conveyed by the feed roller Fa, Fb, the brake roller Ba, Bb, the first conveyance roller C1*a*', C1*b*' and the second conveyance rollers C2*a*, C2*b*, a force from a center side toward both end sides is applied to the conveyed medium, and the medium is pulled toward both end sides.

When the medium is conveyed by the first conveyance roller C1*a*' having a truncated cone shape, as the difference between the diameter D2 of the outer end and the diameter D1 of the inner end is larger, a rotational force F5 toward the outside applied to the medium M is larger. Therefore, as the difference between the diameter D2 of the outer end of the first conveyance roller C1*a*' and the diameter D1 of the inner end of the first conveyance roller C1*a*' is larger, the movement amount of the medium M moving toward the first conveyance roller C1*a*' side in the width direction A8 is larger. In FIG. 7, the movement amount S2 indicates the movement amount of the medium M moving to the first conveyance roller C1*a*' side in the width direction A8 when the medium M is conveyed by 100 mm in the medium conveying direction A1. The movement amount S2 is a factor to remove the wrinkles by spreading the medium.

Figure 8A:
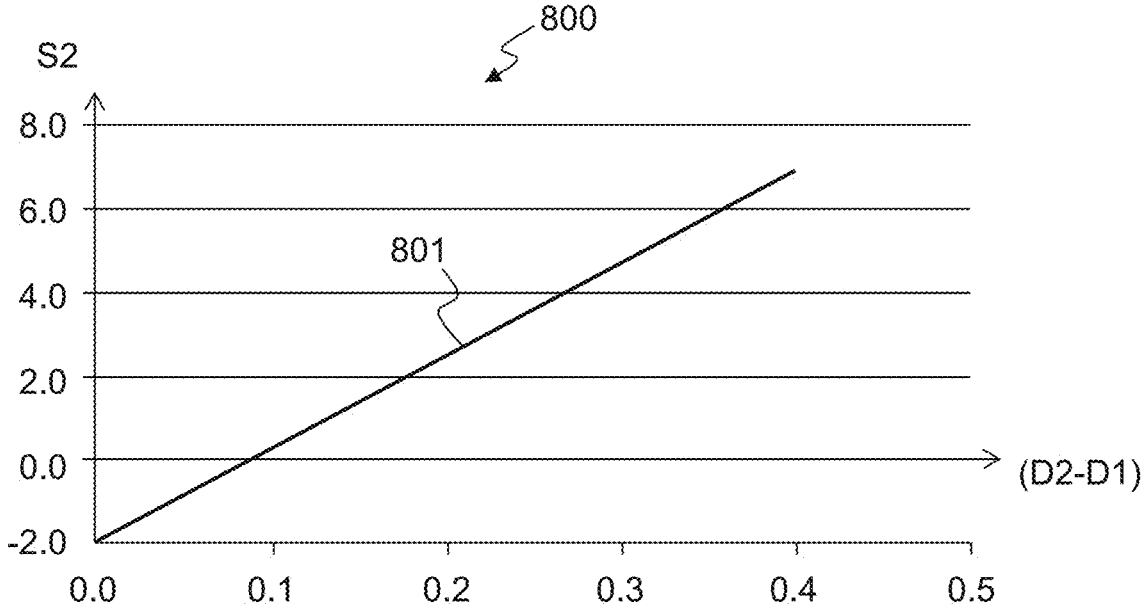
FIG. 8A is a graph showing a relationship between a difference between a diameter D2 and a diameter D1, and a movement amount S2.

FIG. 8A is a graph 800 showing a relationship between the difference between the diameter D2 and the diameter D1, and the movement amount S2.

In FIG. 8A, the horizontal axis indicates the difference (D2−D1) between the diameter D2 and the diameter D1, and the vertical axis indicates the movement amount S2 [mm]. A straight line 801 of the graph 800 is acquired by an experiment in which the movement amount S2 is measured while changing the shape of the first conveyance roller C1*a*' in such a way that the difference between the diameter D2 and the diameter D1 change, in a state in which each roller is located in such a way that {L3/(L2−L1)} is 0.88. As described above, as the difference between the diameter D2 and the diameter D1 is larger, the movement amount S2 is larger. From the straight line 801, the following relational equation (3) is derived.

$$(S2)=(22.449)\times(D2-D1)-2.090 \quad (3)$$

Figure 8B:
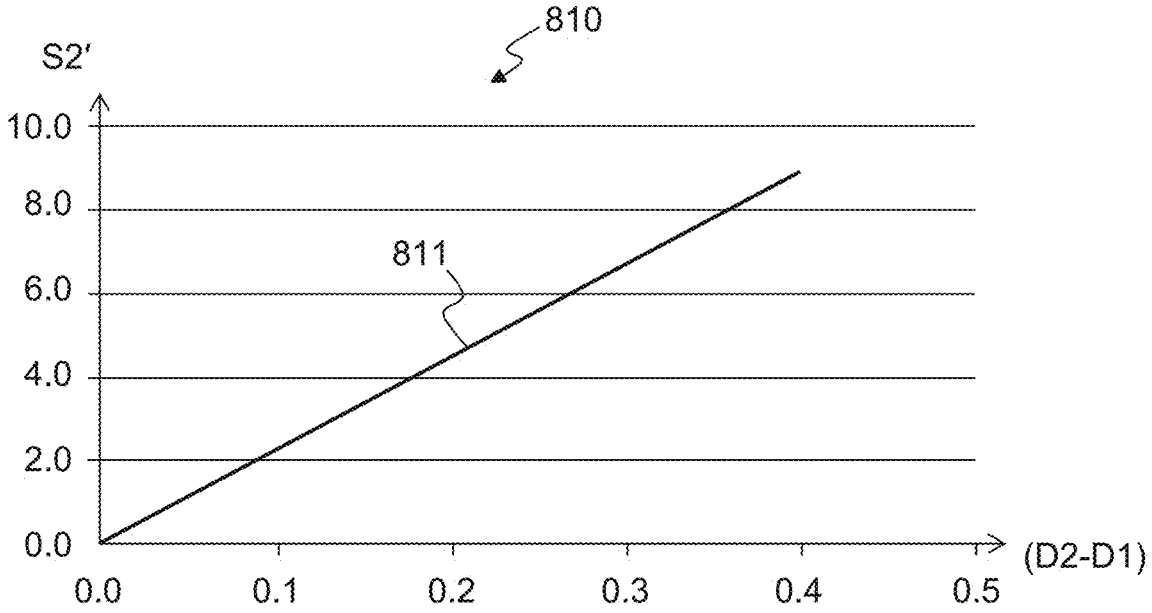
FIG. 8B is a graph showing a relationship between the difference between the diameter D2 and the diameter D1, and a movement amount S2'.

FIG. 8B is a graph 810 showing a relationship between the difference between the diameter D2 and the diameter D1 and the movement amount S2' corrected so as to remove an effect of the separation force by the brake roller.

In FIG. 8B, the horizontal axis of indicates the difference (D2−D1) between the diameter D2 and the diameter D1, and the vertical axis indicates the corrected movement amount S2' [mm]. A straight line 811 of the graph 810 is acquired by adding a value (=2.090 mm) of the movement amount S1 when {L3/(L2−L1)} is 0.88 on the straight line 601 shown in FIG. 6 to the movement amount S2 in the straight line 801 shown in FIG. 8A. In the graph 800, the relationship between the difference between the diameter D2 and the diameter D1, and the movement amount S2 is measured in a state in which the separation force by the brake roller is generated, that is, the movement amount S2 includes the effect by the movement amount S1 due to the separation force. The graph 810 shows a pure movement amount S2' by the difference between the diameter D2 and the diameter D1, which does not include the effect of the separation force by the brake roller. From the straight line 811, the following relational equation (4) is derived.

$$(S2')=(22.449)\times(D2-D1) \quad (4)$$

Figure 9A:
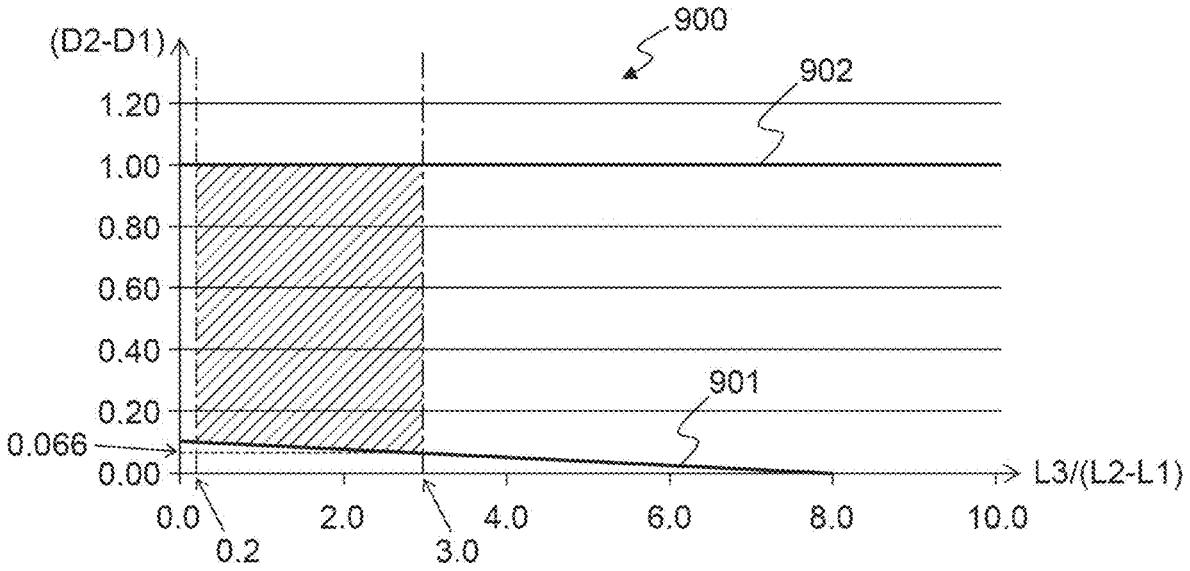
FIG. 9A is a graph showing a good range of the difference between the diameter D2 and the diameter D1.

FIG. 9A is a graph 900 showing a good range of the difference between the diameter D2 and the diameter D1.

In FIG. 9A, the horizontal axis indicates {L3/(L2−L1)}, and the vertical axis indicates the difference (D2−D1) between the diameter D2 and the diameter D1. A straight line 901 of the graph 900 is a group of combinations of {L3/(L2−L1)} and (D2−D1) corresponding respectively to the movement amount S1 and the movement amount S2' having the same value in the straight line 601 in FIG. 6 and the straight line 811 in FIG. 8B. From the straight line 901, the following relational equation (5) is derived.

$$(D2-D1)=(-0.013)\times\{L3/(L2-L1)\}+0.1045 \quad (5)$$

That is, when the relational equation (5) is satisfied, the movement amount S1 and the movement amount S2' are the same value, the medium is conveyed straight toward the medium conveying direction A1. On the other hand, when the left-side value is smaller than the right-side value in the relational equation (5), that is, when the relationship between (D2−D1) and {L3/(L2−L1)} corresponds to the area below the straight line 901 of the graph 900, the movement amount S2 is smaller than the movement amount S1, and the wrinkles (deflection) occurs in the medium. On the other hand, when the left-side value is larger than the right-side value in the relational equation (5), that is, when the relationship between (D2−D1) and {L3/(L2−L1)} corresponds to the area above the straight line 901 of the graph 900, the movement amount S2' is larger than the movement amount S1, and the wrinkles (deflection) does not occur in the medium.

Figure 9B:
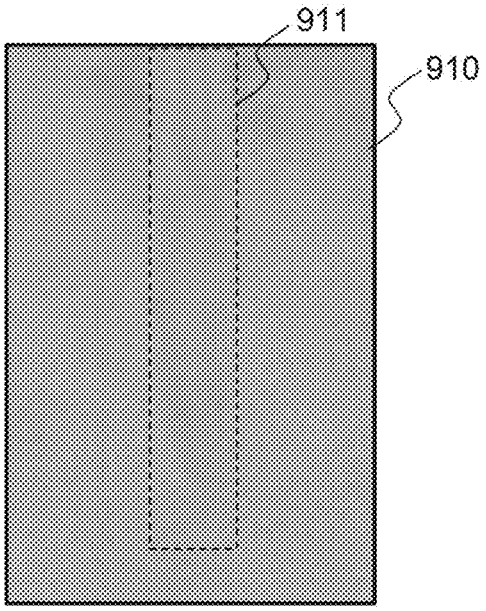
FIG. 9B is an example of an image 910 in which the wrinkled medium is imaged.

FIG. 9B is an example of the input image 910 in which the wrinkled medium is imaged.

As shown in FIG. 9B, in the input image 910 in which the wrinkled medium is imaged, variations occur in a distance between the imaging device 115 and the medium, and the color unevenness occurs in the area 911 corresponding to the wrinkles (the bright area and the dark area are mixed).

However, if the movement amount S2' is too large than the movement amount S1, the medium may be broken (ruptured) when the thin paper is conveyed as a medium. Experimental results of conveying a predetermined medium while changing the shape of the first conveyance roller in such a way that the difference between the diameter D2 of the outer end of the first conveyance roller and the diameter D1 of the inner end of the first conveyance roller changes, showed that the medium is likely to break when the difference (D2−D1) is larger than 1.00 mm. The predetermined medium is A4 size paper with a thickness of 0.04 mm. A straight line 902 of the graph 900 in FIG. 9A is represented by the following equation (6) and indicates a boundary where the breakage occurs in a medium when a thin paper is conveyed as the medium.

$$(D2-D1)=1.00 \quad (6)$$

That is, when the left-side value is larger than the right-side value in the relational expression (6), that is, (D2−D1) corresponds to the area above the straight line 902 of the graph 900, it is highly likely that the breakage occurs in the medium. On the other hand, when the left-side value is equal to or less than the right-side value in the relational expression (6), that is, (D2−D1) corresponds to the area below the straight line 902 of the graph 900, it is unlikely that the breakage occurs in the medium.

Therefore, when the left-side value is equal to or more than the right-side value in the relational expression (5) and the left-side value is equal to or less than the right-side value in the relational expression (6), it is highly likely that neither the wrinkles nor the breakage occur in the medium. That is, when the relationship between (D2−D1) and {L3/(L2−L1)} corresponds to the area above straight line 901 of the graph 900 and (D2−D1) corresponds to the area below straight line 902 of the graph 900, it is highly likely that neither the wrinkles nor the breakage occur in the medium.

In a medium conveying apparatus, such as a general scanner, the minimum standard size of the supported medium is the B9 size (45 mm×64 mm). When the distance L1 in the width direction A8 between the outer ends of the feed roller pairs is 45 mm or more, the medium having the B9 size and the medium having a size larger than the B9 size thereon placed (mixed) on the medium tray 103 are conveyed together. Therefore, the distance L1 between the outer ends of the feed roller pairs in the width direction A8 is preferably set to 45 mm or less.

In general, in order to sandwich the medium reliably by the conveying roller pairs, it is necessary that the conveying roller pairs and the medium come into contact with each other by 25 mm or more. Therefore, in order to stably convey the medium of the B9 size by the conveying roller pairs, the distance in the width direction A8 between the inner ends of the conveying roller pairs is set to (45 mm−25 mm=20 mm) or more. Further, in the medium conveying apparatus, the medium may be placed at a position shifted from the central position in the width direction A8 on the medium tray, and the medium may be conveyed by only one conveying roller pair. In general, in order to stably convey the medium by only one conveying roller pair, the size in the width direction A8 of the conveying roller pair is required to be 20 mm or more. Therefore, the distance L2 between the outer ends of the conveying roller pair in the width direction A8 is preferably set to (20 mm+20 mm×2=60 mm or more).

Further, in order to convey the medium of the B9 size (45 mm×64 mm), the distance L3 between the rotation axis of the feed roller pairs and the rotation axis of the conveying roller pairs in the medium conveying direction A1 is required to be 45 mm or less. Therefore, in a general medium conveying apparatus, the maximum value of {L3/(L2−L1)} is set to {45 mm/(60 mm−45 mm)}=3.0.

On the other hand, similarly to the conveying roller pairs, in order to sandwich the medium reliably by the feed roller pairs, it is necessary that the feed roller pairs and the medium come into contact with each other by 25 mm or more. Therefore, the distance L1 between the outer ends of the feed roller pairs in the width direction A8 is preferably set to 25 mm or more.

Further, the conveying roller pairs can stably convey the medium, as the length in the width direction A8 is longer. However, in general, when the length in the width direction A8 of the conveying roller pairs exceeds 50 mm, the ratio of the degree of improvement in the stability of the conveyance of the medium to a cost increase due to an increase in an amount of use of a member, such as a rubber, decreases. Thus, in consideration of the cost effectiveness, the length in the width direction A8 of the conveying roller pairs is preferably 50 mm or less. Therefore, for example, when the inner ends of the conveying roller pairs are located at substantially the same position as the outer ends of the feed roller pairs in the width direction A8, the distance L2 between the outer ends of the conveying roller pairs in the width direction A8 is preferably set to (25 mm+50 mm×2=125 mm) or less.

Further, the distance L3 between the rotation axis of the feed roller pairs and the rotation axis of the conveying roller pairs in the medium conveying direction A1 is required to be 20 mm or more in such a way that rubber portions of the feed roller pairs and rubber portions of the conveying roller pairs do not interfere with each other. Therefore, in a general medium conveying apparatus, the minimum value of {L3/(L2−L1)} is set to {20 mm/(125 mm−25 mm)}=0.2.

In the straight line 901 of the graph 900 in FIG. 9A, (D2−D1) is 0.102 mm when {L3/(L2−L1)} is 0.2, and (D2−D1) is 0.066 mm when {L3/(L2−L1)} is 3.0. Therefore, when (D2−D1) is 0.06 mm or more, the general medium conveying apparatus can suppress the occurrence of the wrinkles in the medium. That is, the medium conveying apparatus 100 can suppress both the occurrence of the wrinkles and the breakage of the medium, by setting (D2−D1) to 1.00 mm or less and 0.06 mm or more. In particular, the medium conveying apparatus 100 can suppress both the occurrence of the wrinkles and the breakage of the medium, by setting (D2−D1) so as to correspond to a shaded portion of the graph 900, that is, in such a way that (D2−D1) is 1.00 mm or less and satisfies the following equation (7).

$$(D2-D1)\geq(-0.013)\times\{L3/(L2-L1))\}+0.1045 \quad (7)$$

As described in detail above, the medium conveying apparatus 100 can suppress the occurrence of the wrinkles of the medium while suppressing the occurrence of the breakage of the medium, by setting the difference (the amount of the taper) between the diameter of the outer end of the conveying roller pairs and the diameter of the inner end of 0.06 mm or more and 1.00 mm or less.

Figure 10A:
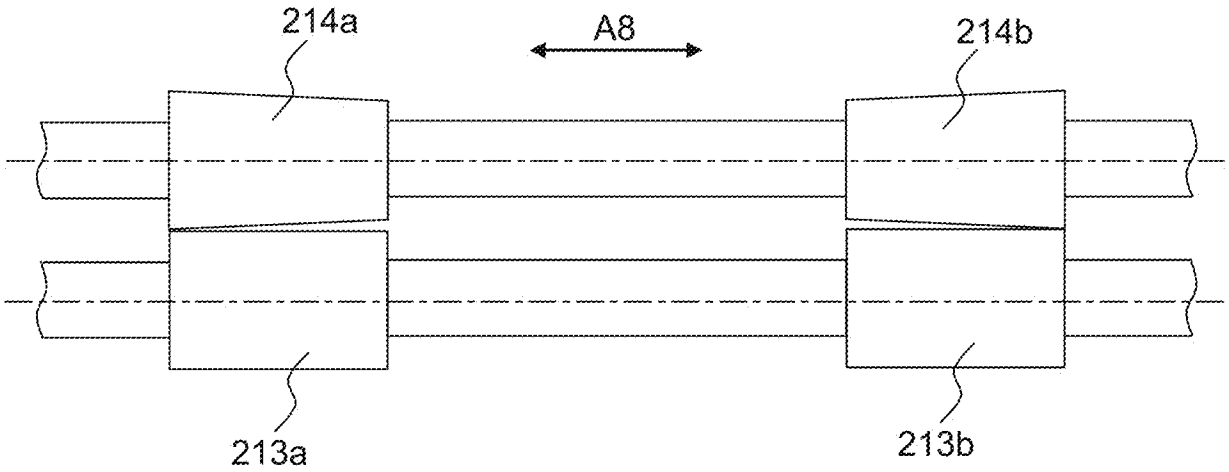
FIG. 10A is a schematic diagram for illustrating another pair of conveying rollers.

FIG. 10A is a schematic diagram for illustrating conveying roller pairs in a medium conveying apparatus according to another embodiment.

As shown in FIG. 10A, the medium conveying apparatus according to the present embodiment, includes first conveyance rollers 213*a* and 213*b*, instead of the first conveyance rollers 113*a* and 113*b*, and includes second conveyance rollers 214*a* and 214*b*, instead of the second conveyance rollers 114*a* and 114*b*. Hereinafter, the first conveyance rollers 213*a* and 213*b* may be collectively referred to as first conveyance rollers 213, and the second conveyance rollers 214*a* and 214*b* may be collectively referred to as second conveyance rollers 214.

The first conveyance rollers 213 have a cylindrical shape, and are provided in such a way that diameters are uniform at each position in the width direction A8 of the first conveyance rollers 213, respectively. On the other hand, the second conveyance rollers 214 have a truncated cone shape, and are provided so that a surface having the larger diameter is located on the outside in the width direction A8, and a surface having the smaller diameter is located on the center side in the width direction A8, respectively. That is, the second conveyance rollers 214 are provided in such a way that a diameter of an outer end in the width direction A8 of the second conveyance roller 214 is larger than a diameter of an inner ends in the width direction A8 of the second conveyance roller 214, respectively.

Similar to the first conveyance rollers 113 and the second conveyance rollers 114, the first conveyance rollers 213 and the second conveyance rollers 214 (the conveying roller pairs) are provided in such a way that a total D of differences between the diameter of the outer end of each conveyance roller and the diameter of the inner end of each conveyance roller is 0.06 mm or more and 1.00 mm or less. In particular, the first conveyance roller 213 and the second conveyance roller 214 is provided in the medium conveying apparatus 100 in such a way that the total D of the differences between the diameter of the outer end of each conveyance roller and the diameter of the inner end of each conveyance roller satisfies the above equation (1).

In the present embodiment, since the difference between the diameter of the outer end and the diameter of the inner end of each of the first conveyance rollers 213 is 0, the difference between the diameter of the outer end and the diameter of the inner end of each of the second conveyance rollers 214 is equal to the total D of the differences between the diameter of the outer end and the diameter of the inner end of each conveyance roller.

As described in detail above, the medium conveying apparatus can suppress the occurrence of the wrinkles in the medium while suppressing the occurrence of the breakage of the medium even when the second conveyance roller has a tapered shape. That is, in the medium conveying apparatus, for each of the conveying roller pairs, the diameter of the outer end in the width direction A8 of at least one conveyance roller may be larger than the diameter in the width direction A8 of the inner end of one conveyance roller, among the first conveyance roller and the second conveyance roller.

Figure 10B:
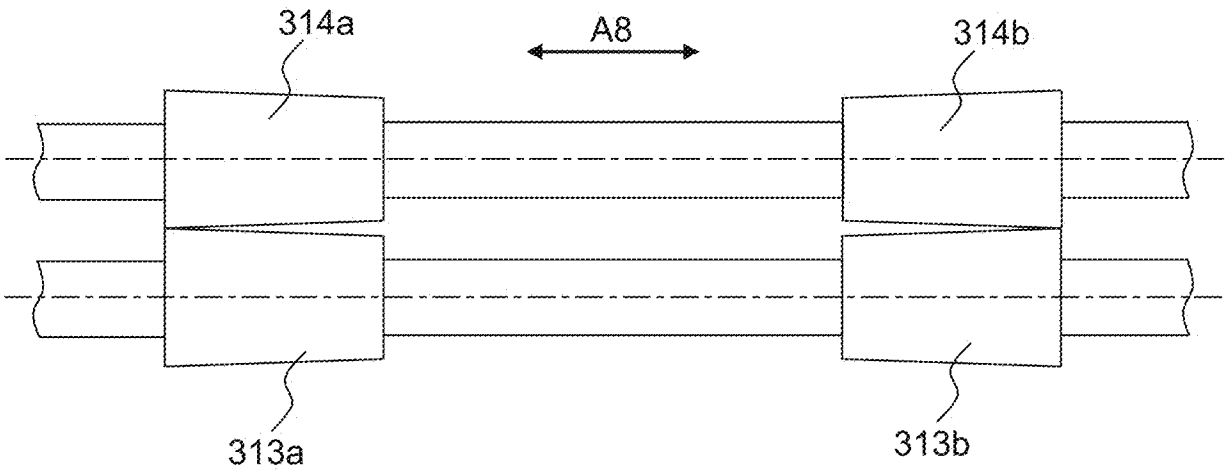
FIG. 10B is a schematic diagram for illustrating still another pair of conveying rollers.

FIG. 10B is a schematic diagram for illustrating conveying roller pairs in a medium conveying apparatus according to still another embodiment.

As shown in FIG. 10B, the medium conveying apparatus according to the present embodiment, includes first conveyance rollers 313*a* and 313*b*, instead of the first conveyance rollers 113*a* and 113*b*, and includes second conveyance rollers 314*a* and 314*b*, instead of the second conveyance rollers 114*a* and 114*b*. Hereinafter, the first conveyance rollers 313*a* and 313*b* may be collectively referred to as first conveyance rollers 313, and the second conveyance rollers 314*a* and 314*b* may be collectively referred to as second conveyance rollers 314.

The first conveyance rollers 313 and the second conveyance rollers 314 have a truncated cone shape, and are provided so that a surface having the larger diameter is located on the outside in the width direction A8, and a surface having the smaller diameter is located on the center side in the width direction A8, respectively. That is, the first conveyance rollers 313 and the second conveyance rollers 314 are provided in such a way that a diameter of an outer end in the width direction A8 of each conveyance roller is larger than a diameter of an inner ends in the width direction A8 of each conveyance roller, respectively.

Similar to the first conveyance rollers 113 and the second conveyance rollers 114, the first conveyance rollers 313 and the second conveyance rollers 314 (the conveying roller pairs) are provided in such a way that a total D of differences between the diameter of the outer end of each conveyance roller and the diameter of the inner end of each conveyance roller is 0.06 mm or more and 1.00 mm or less. In particular, the first conveyance roller 313 and the second conveyance roller 314 is provided in the medium conveying apparatus 100 in such a way that the total D of the differences between the diameter of the outer end of each conveyance roller and the diameter of the inner end of each conveyance roller satisfies the above equation (1).

As described in detail above, the medium conveying apparatus can suppress the occurrence of the wrinkles in the medium while suppressing the occurrence of the breakage of the medium even when both the first conveyance roller and the second conveyance roller has a tapered shape.

REFERENCE SIGNS LIST

100 medium conveying apparatus

111 feed roller

112 brake roller

113 first conveyance roller

114 second conveyance roller

What is claimed is:

1. A medium conveying apparatus comprising:

feed roller pairs spaced and located in a direction perpendicular to a medium conveying direction, to separate and feed a medium; and conveying roller pairs each including a first conveying roller and a second conveying roller, and respectively spaced and located on a downstream side of the feed roller pairs in the medium conveying direction, and spaced and located in the direction perpendicular to the medium conveying direction, wherein for each of the conveying roller pairs, a diameter of an outer end in the direction perpendicular to the medium conveying direction of each of the first conveying roller and the second conveying roller is larger than a diameter of an inner end in the direction perpendicular to the medium conveying direction of said each of the first conveying roller and the second conveying roller, and a total D of a difference between the diameter of the outer end and the diameter of the inner end of the first conveying roller and a difference between the diameter of the outer end and the diameter of the inner end of the second conveying roller is in a range of 0.06 to 1.00 mm.

2. The medium conveying apparatus according to claim 1, wherein the conveying roller pairs are provided in the medium conveying apparatus in such a way that the total D satisfies the following equation, $$D \geq (-0.013) \times \{L3/(L2-L1))\} + 0.1045$$

where L1 is a distance between outer ends of the feed roller pairs in the direction perpendicular to the medium conveying direction, L2 is a distance between the outer ends of the conveying roller pairs in the direction perpendicular to the medium conveying direction, and L3 is a distance between a rotation axis of the feed roller pairs and a rotation axis of the conveying roller pairs in the medium conveying direction.

* * * * *